US007784419B2

(12) United States Patent
Bigler et al.

(10) Patent No.: US 7,784,419 B2
(45) Date of Patent: Aug. 31, 2010

(54) FLOATING DOCK STRUCTURE

(75) Inventors: Olivier Bigler, Repentigny (CA); Claude Barbeau, St-Bruno (CA)

(73) Assignee: Gestion Radisson Design Inc., Sainte-Agathe-des-Monts, Quebec (CA)

( * ) Notice: Subject to any disclaimer, the term of this patent is extended or adjusted under 35 U.S.C. 154(b) by 179 days.

(21) Appl. No.: 12/122,092

(22) Filed: May 16, 2008

(65) Prior Publication Data

US 2009/0283025 A1 Nov. 19, 2009

(51) Int. Cl.
*B63B 35/44* (2006.01)
*E02B 3/00* (2006.01)

(52) U.S. Cl. ..... 114/263; 114/264; 114/267

(58) Field of Classification Search ..... 114/258, 114/263, 264, 266, 267
See application file for complete search history.

(56) References Cited

U.S. PATENT DOCUMENTS 3,103,907 A * 9/1963 Scholley ..... 114/266
4,078,515 A * 3/1978 Svirklys ..... 114/266
4,602,587 A * 7/1986 Lyons ..... 114/264
4,940,021 A 7/1990 Rytand
5,845,594 A * 12/1998 Hallsten et al. ..... 114/263
7,568,253 B2 * 8/2009 de la Chevrotiere ..... 14/14

FOREIGN PATENT DOCUMENTS

FR 2 886 657 12/2006

* cited by examiner

*Primary Examiner*—S. Joseph Morano
*Assistant Examiner*—Daniel V Venne
(74) *Attorney, Agent, or Firm*—Ogilvy Renault LLP

(57) ABSTRACT

A floating dock structure is comprised of a pair of single-piece side rails secured together in spaced-apart substantially parallel relationship by a plurality of single-piece cross-members connected between the side rails to a lower tubular portion thereof. The side rails are hollow, tubular aluminum extruded side rails defining a top wall, an exterior side wall, a bottom wall and an interior side wall spaced inwardly from the exterior side wall. Elongated deck support stringers are secured in spaced-apart relationship on a top wall of the cross-members. Decking floor members are supported by the deck support stringers elevated from the top face of the cross-members a distance of up to about five inches (5 inches) to create underfloor passages adapted for the passage of conduits and services material. Floatation support casings are secured under the cross-members.

19 Claims, 4 Drawing Sheets

FLOATING DOCK STRUCTURE

TECHNICAL FIELD

The present invention relates to a floating dock structure having a pair of aluminum extruded hollow side rails and cross-members which are secured to a lower tubular portion of the side rails and extending therebetween to provide a metal dock structure which is highly resistant to impact loads and torquing forces and which provides improved underfloor space for the passage of service conduits and material.

BACKGROUND ART

Docks formed from aluminum extrusions and metal trusses and beams are known in the art. However, there are several problems associated with such known floating docks. One such problem is the torquing force in the connecting structure between the side rails of the dock when the dock is subjected to large wave action or impact forces imparted to the dock by large yachts when docking or during severe weather conditions. The torquing forces imparted in the framework interconnecting the side rails will often cause damage to the framework and the connection to floatation casings secured. Thereto there is often a requirement for repair. It is not easy to repair docks because of the many watercrafts that are docked. Another disadvantage of such docks is that they do not provide sufficient space underneath the floor structure for the passages of large conduits which are required to provide proper service to larger yachts, such as megayachts, wherein piping of four to five inches (4 to 5 inches) in outer diameter is required. If the piping or conduits are water-pressure conduits, then there is a need to provide a dock which has sufficient rigidity to prevent damage to these conduits when the dock is subjected to severe wave action. The side rails need to be designed for maximum strength and impact force transfer into the frame structure of the dock to withstand severe wave action.

It is also known to provide floating metal docks with concrete slab decking supported on metal stringers. However, the contact between the concrete slabs and the metal support stringers make the dock noisy during displacement by wave action wherein the concrete slabs are frictionally displaced in contact with the metal stringers. Another disadvantage is that because of this friction and the fact that the concrete is in contact with salt water or fresh water, the concrete deteriorates at the friction areas and this causes deterioration of the slabs and damages the support surfaces of the stringers. A still further disadvantage is that many of these metal docks have their side rails, cross-members and stringers constructed of several parts which may be attached together by bolt fasteners or by welding. The bolt fasteners become loose with time due to the torquing action of the frame and require to be retightened. If the parts are welded together, this makes the dock more costly to fabricate and the many welds may be subject to breakage, particularly with members subjected to torquing force.

SUMMARY OF INVENTION

It is therefore a feature of the present invention to provide a floating dock structure which substantially overcomes the above-mentioned disadvantages of the prior art mentioned hereinabove.

Another feature of the present invention is to provide a floating dock structure which is comprised of aluminum extruded one-piece side rails of reinforced design and capable of transferring lateral impact forces into the dock frame structure.

Another feature of the present invention is to provide a floating dock structure having aluminum extruded cross-members to interconnect the reinforced side rails and which are constructed of a single extruded piece having a hollow structural anti-torquing design which permits connection to a floating system under the dock.

Another feature of the present invention is provide a floating dock structure capable of receiving under its decking floor continuous service conduits having external diameters of up to five inches (5 inches).

Another feature of the present invention is to provide a floating dock structure having a novel floor decking stringer design capable of supporting concrete tiles or other flooring material of different thicknesses.

Another feature of the present invention is to provide a floating dock structure having a concrete slab decking which is supported on connectors which isolate the concrete slabs from contact with the metal support members of the dock structure to eliminate noise and wear and permit ease of assembly and repair and provide access to the space under the floor.

Another feature of the present invention is to provide a floating dock structure having cross-members of anti-torquing design and which at the same time provides for interconnection to floatation casings positioned thereunder.

Another feature of the present invention is to provide extruded or molded plastics isolating connectors which are removably connectable to the side rails and to the stringers and of different configuration for the support of concrete tiles of different sizes and thicknesses.

According to a broad aspect of the present invention there is provided a floating dock structure which is comprised of a pair of side rails secured together in spaced-apart substantially parallel relationship by a plurality of cross-members connected between the side rails to a lower tubular portion of the side rails. The side rails are a single-piece, hollow, tubular aluminum extruded side rails which define a top wall, an exterior side wall, a bottom wall and an interior side wall spaced inwardly from the exterior side wall. One or more braces are provided between the exterior side wall and the interior side wall. Elongated deck support stringers are secured in spaced-apart relationship on a top wall of the cross-members and extend in substantially parallel relationship to each other and to the side rails. Decking floor members are supported by the deck support stringers elevated from the top wall of the cross-members to create underfloor passages to receive conduits having outside diameters of up to five inches and services material. Connectors secure floats under the cross-members.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
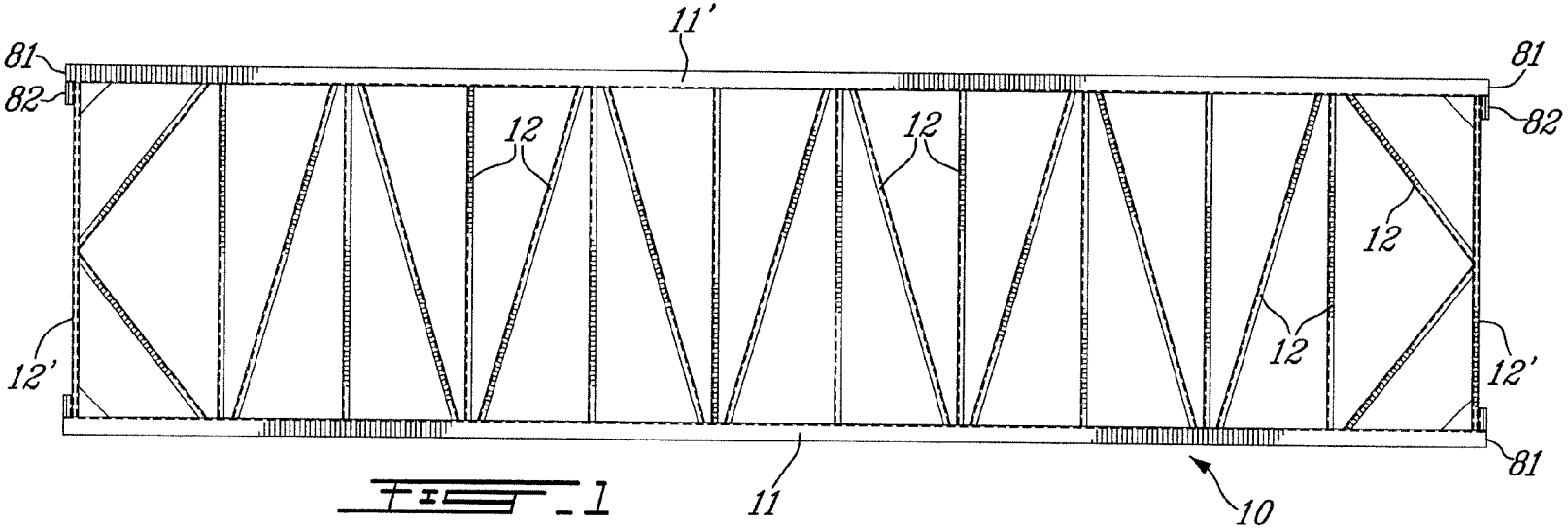
FIG. 1 is a top view of the metal floating dock frame structure of the present invention showing the interconnection of the side rails by the cross-members.
Figure 2:
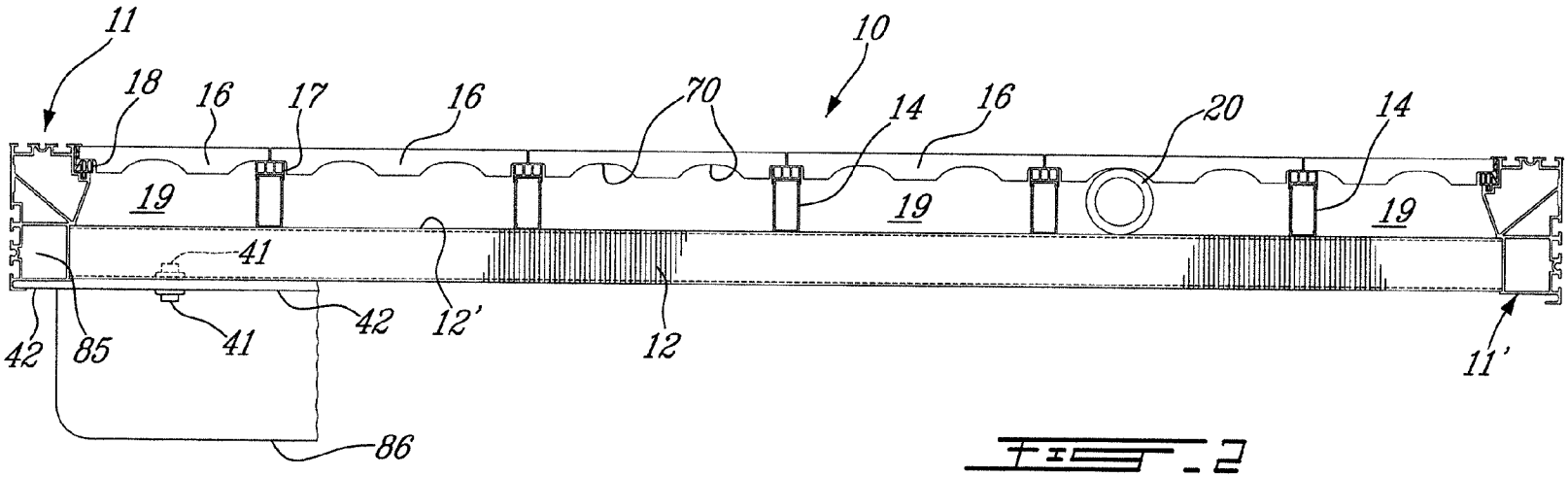
FIG. 2 is a transverse section view through the floating dock structure showing concrete decking tiles supported between stringers and the side rail members.

Referring now to the drawings and more particularly to FIGS. 1 and 2, there is shown generally at 10 the floating dock structure of the present invention. The floating dock structure is a metal structure and is comprised of a pair of aluminum extruded, one-piece, side rails 11 and 11' which are secured together in spaced-apart substantially parallel relationship by a plurality of cross-members 12. The cross-members 12 are also aluminum extruded one-piece members and they are secured to a lower tubular portion 13 of the side rails 11 by welding. A plurality of elongated deck support stringers 14 are secured in spaced-apart parallel relationship on a top wall 12' of the cross-members 12 by welding as shown at 15 in FIG. 3A. Decking floor members 16; hereinshown in the form of concrete tiles, are supported between the side rails 11 and 11' by the stringers 14 and more specifically on decking support connectors 17 removably secured to the top end of the deck support stringers 14 and by connectors 18 also removably secured to the side rails 11 and 11' A feature of the floating dock structure of the present invention, and as more clearly seen from FIG. 2, is that the dock structure provides underfloor passages 19 which are adapted to receive service conduits, such as the conduit 20, having an outside diameter of up to five inches which, heretofore, has not been available with existing aluminum extruded floating dock structural designs.

With further reference now to FIGS. 3A to 6, it can be seen that the hollow aluminum extruded side rails 11 and 11' define a top reinforced structural hollow portion 21 formed above the lower tubular portion 13. The side rails 11 and 11' have a top wall 22, an exterior side wall 23, a bottom wall 24 and an interior side wall 25 which is spaced inwardly from the exterior side wall by bracing walls which are constituted by the top wall 22, the bottom wall 24, an intermediate bracing wall 26 and a diagonal bracing wall 27. The diagonal bracing wall 27 extends from about mid-length of the exterior side wall portion 23' in the top reinforced structural portion 21, to a lower end of the interior side wall portion 25' in the top reinforced structural portion 21, to terminate at a top edge 28 of the lower tubular portion 13. As is more clearly shown in FIG. 4, the mid-length portion of the exterior side wall portion 23' of the top structural portion 21 has a thickened wall portion 29. All of these walls are integrally formed by the one-piece extrusion.

Figure 3A:
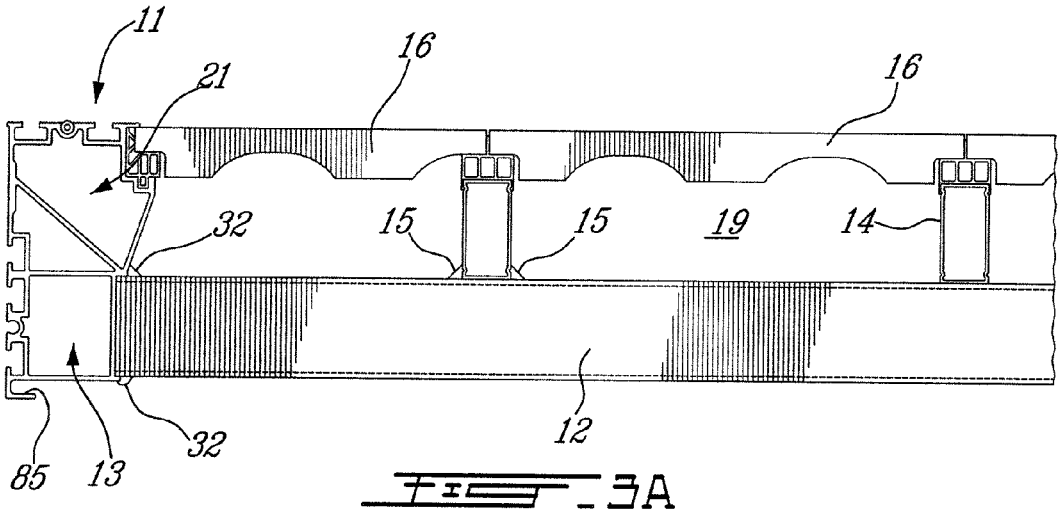
FIG. 3A is an enlarged partial view of FIG. 2.

The lower tubular portion 13 is substantially of rectangular cross-section and the interior side wall portion 25" thereof defines an outwardly extending connecting channel 30 therealong defined between spaced-apart connecting flanges 31 and 31' projecting from opposed ends of the interior side wall portion 25". The connecting channel 30 defines a cross-member receiving channel to which the cross-members are welded, as shown in FIGS. 2 and 3A, by welds 32.

Figure 5:
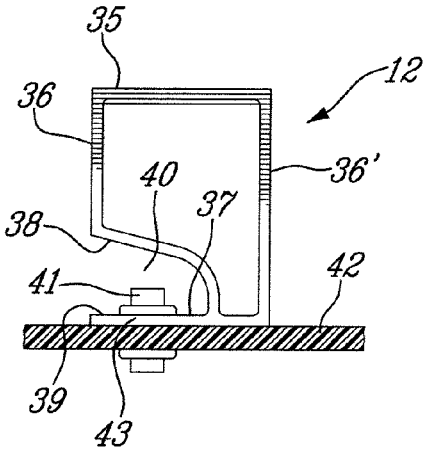
FIG. 5 is a cross-section view of a cross-member illustrating the extruded aluminum profile thereof and its connection to a securement flange of a floatation casing.

As shown in FIG. 5, the cross-members 12 are each formed by a single piece elongated hollow aluminum extrusion. Each cross-member 12 has a top wall 35, opposed spaced-apart side walls 36 and 36' and a bottom wall 37. One of the side walls, herein side wall 36, has an inwardly curved lower wall section 38 terminating in the bottom wall 37 whereby the bottom wall defines a connecting flange wall portion 39 and part of the tubular portion. The inwardly curved lower wall portion 38 is shaped to define an access space 40 between the connecting flange portion 39 and the inwardly curved lower wall portion 38 to receive connecting bolts, such as connecting bolt 41, to secure floating casings thereto. The connecting flange 42 of the casings is hereinshown secured to the cross-member 12. Holes 43 are provided in the connecting flange wall portion 39 to receive the bolt connectors 41 therethrough.

It can therefore be seen from FIG. 5 that the cross-members are shaped to form an anti-torquing tubular structural, hollow rigid portion, defined between the top wall, the side walls and a portion of the lower wall to provide structural anti-torquing rigidity while at the same time providing a connecting flange. In known prior art metal decking structures, some of the cross-members were provided by C-shaped metal beams having opposed parallel walls and a connecting side wall and such do not offer sufficient anti-torquing structural rigidity when the docks are occupied by large yachts which can impart large impact forces on the side rails of the dock. The improved cross-member design of the present invention overcomes such problems.

Figure 6:
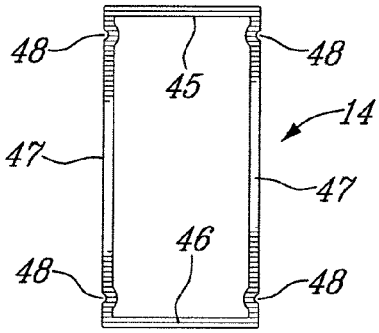
FIG. 6 is a cross-section view of an aluminum extruded hollow deck support stringer.

As shown in FIG. 6, the elongated deck support stringers 14 are also hollow extruded aluminum stringers of substantially rectangular cross-section and define a flat top wall 45, a flat bottom wall 46 and opposed side walls 47. Connecting slots 48 are integrally formed along the stringers and extend in parallel spaced relationship from each of the top wall 45 and bottom wall 46 whereby to receive in sliding or snap-fit connection therewith, the decking support connectors 17. By providing these connecting slots 48 in the side walls adjacent opposed end walls 45 and 46, the stringers can be secured to the cross-members with either the top wall 45 or bottom wall 46 welded to the cross-pieces thus making it a fool-proof installation of these stringers onto the cross-members.

Figure 7A:
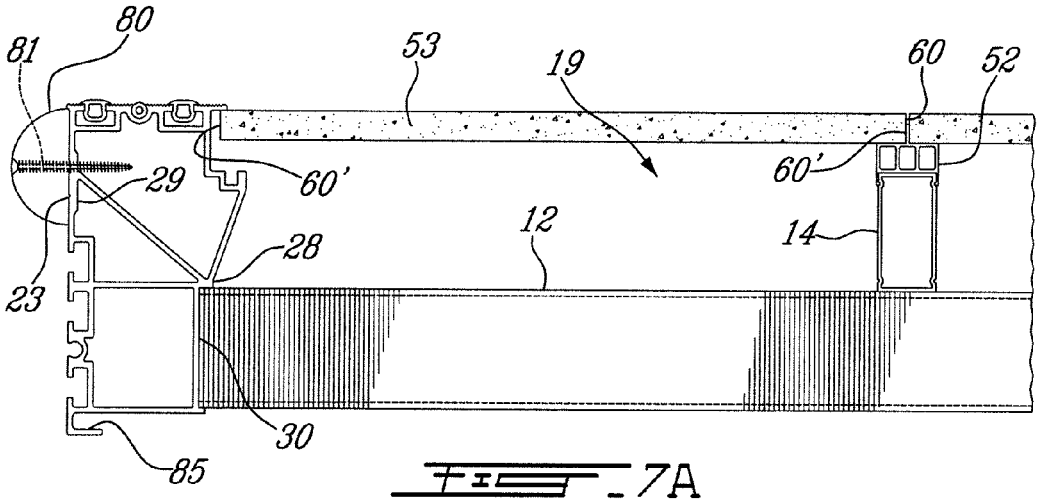
FIG. 7A is a fragmented section view of the floating dock structure showing a concrete tile supported thereby and the configuration of the stringer decking support connector.

Referring again to FIG. 4, it can be seen that the interior side wall and particularly the interior upper side wall portion 25', 11, 11', projects inwardly upwards whereby an integrally formed deck supporting connecting channel 50 may be formed in a top portion of this interior wall portion 25' and supported by the angulated interior wall portion 25' which at a lower end connects to the top edge of the lower tubular reinforced portion 13. This deck support connecting channel 50 is shaped to receive a decking support isolating connector 18 of the type illustrated in FIG. 9A whereby to support decking floor members such as the decking member 16 and isolated from the aluminum extruded side rail. The configuration of the deck supporting connecting channel 50 permits the docking support isolating connector 18 to be easily positioned therein and retained captive once a decking member is supported or connected thereto. It can also be seen that because the interior wall portion 25' is angulated from the lower connecting wall 50' of the connecting channel 50, the load is transferred downwardly into the top edge of the lower tubular structural portion 13 and to the cross-members connected thereto. Accordingly, the load on the connecting channel 50 is transmitted to the top edge connection 28 as well as in the lateral load from the exterior side wall 23 created by impact force onto the side rail by docking watercrafts. Pumper 80, as shown in FIG. 7A, are secured to the exterior side wall 23, as shown in FIG. 7A, by lag bolts 81 which extend through the reinforced or thickened wall portion 29 of the side rail.

Figure 7B:
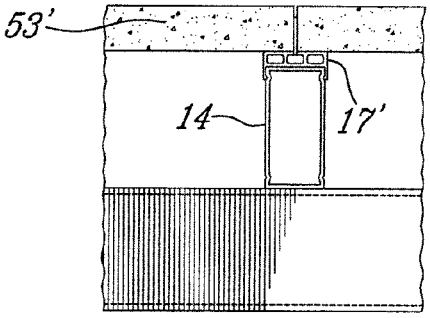
FIG. 7B is a fragmented section view showing a concrete tile of increased thickness and a decking support connector of different configuration.
Figure 8A:
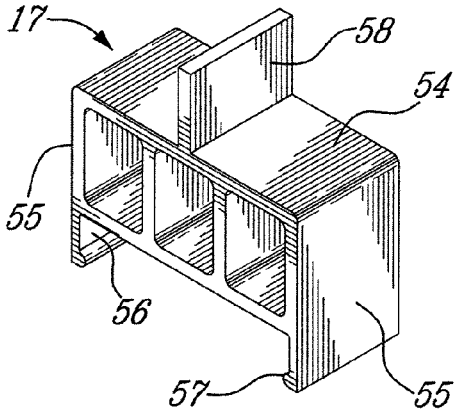
FIG. 8A is a perspective view of the decking support connector illustrated in FIG. 7A.
Figure 8B:
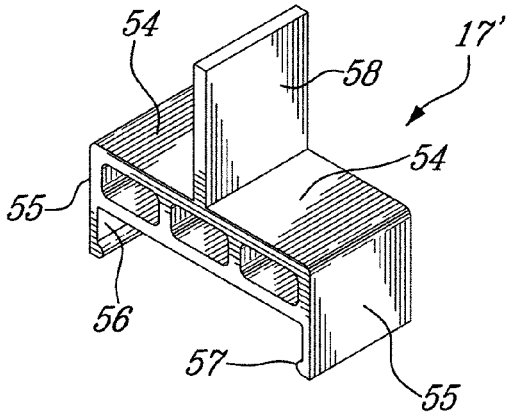
FIG. 8B is a perspective view of the decking support connector illustrated in FIG. 7B.
Figure 8C:
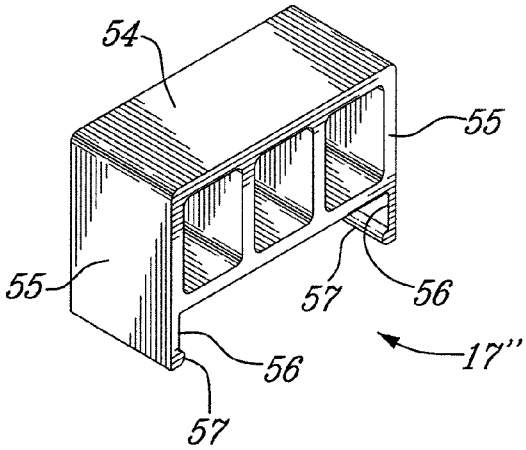
FIG. 8C is a perspective view of the decking support connector illustrated in FIG. 7C.
Figure 9A:
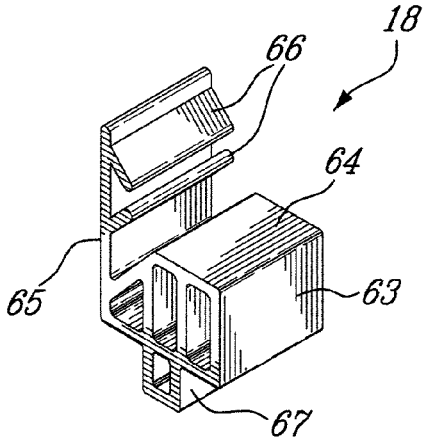
FIG. 9A is a perspective view of the decking support connector which is secured to the side rails and of the type illustrated in FIG. 3A.
Figure 9B:
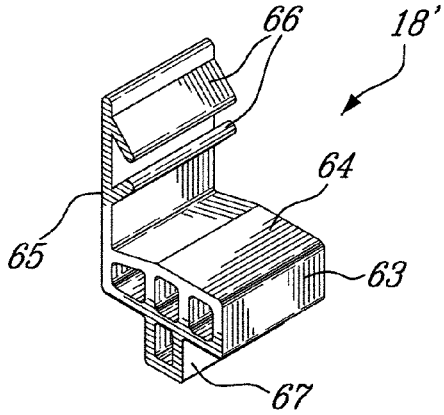
FIG. 9B is a perspective view of a decking support connector connected to the side rail but adapted to support a concrete slab which has an increased thickness, as shown in FIG. 7B.

As shown in FIGS. 8A to 9B, there are decking support isolating connectors adapted to be removably secured to the deck support connecting channels, herein connectors 18 and 18', as shown in FIGS. 9A and 9B, and to the top end, either top or bottom walls 45 and 46, of the stringers 14 and as illustrated by the connectors 17, 17' and 27" illustrated in FIGS. 8A to 8C. These support isolating connectors are interchangeable connectors of different configurations to provide for a height adjustment between the top wall 22 of the side rails 11 and 11' and the top face or top wall of the cross-members 12 whereby to accommodate decking floor members, such as concrete decking tiles 53 and 53', as shown in FIGS. 7A and 7B of different thicknesses. The tile as shown in FIG. 7A has a thickness of one inch (1 inch) whereby the tile of FIG. 7B has a thickness of one and a half inches (1½ inches). To accommodate these tiles of different thicknesses, the support wall surface 64 of the decking support isolating connectors 17 and 18 need to be adjusted in height. The decking connectors are formed from extruded insulating material, herein a PVC plastic material, to isolate the decking floor members, herein the concrete tiles, from the metallic deck support stringers and the metallic side rails. The PVC material provides both isolation from direct contact and noise suppression.

Figure 7C:
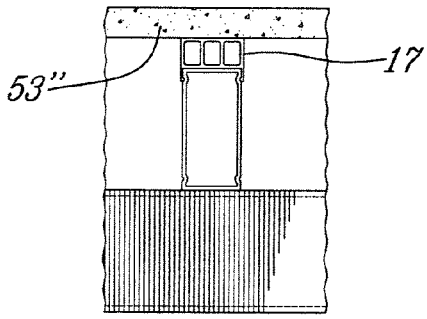
FIG. 7C is a view similar to FIG. 7B but showing a decking support connector of a still further configuration supporting a different type of decking floor.

As shown in FIGS. 8A to 8C, the decking support connectors 17, 17' and 17" have a flat supporting top wall 54, opposed parallel side walls 55 and opposed connecting flange walls 56. The flange walls 56 terminate with internally facing connecting rib 57 dimensioned for snap-fit retention into the connecting slots 48 of the deck support stringers 14, shown in FIG. 6. The decking support connector 17', as shown in FIG. 8C, is of a type adapted to support a flat decking slab 53" thereover, as shown in FIG. 7C, and such slab could extend from the opposed side rails 11 and 11' or across two or more stringers 14. The decking support connector 17 shown in FIG. 8A is herein provided with a central vertical flange wall 58 projecting from the top wall 54 and disposed for longitudinal alignment with the elongated deck support stringers 14. When supporting rectangular or square concrete tiles, as shown in FIG. 7A, these tiles are dimensioned to span and be supported by adjacent parallel ones of the deck support stringers with the vertical flange wall 58 being disposed between opposed side edges 60 and 60' of the concrete tiles 53, as shown in FIG. 7A, to eliminate friction. It is pointed out that FIG. 7A does not show the decking support connector 18 but such is shown in FIG. 3A on which is supported the opposed end of the concrete tile 53.

As shown in FIGS. 8A and 8B, the thickness of the support wall 54 of the decking support isolating connector is different whereby to support tiles of different thicknesses. In this particular case, as illustrated by the connectors of FIGS. 8A and 8B, and as shown in FIGS. 7A and 7B, the thickness of the support wall of the connectors permits concrete tiles of two different thicknesses to be supported.

As shown in FIGS. 9A and 9B, the decking support connectors 18 and 18' are configured to define a decking floor member support section 63 having a flat top support wall 64 and an inwardly spaced vertical projecting wall 65 projecting above the support wall 64. The vertical projecting wall 65 has at least one, herein a pair of angulated flexible flanges 66 projecting at an angle towards one another and towards the top wall 64 of the deck supporting connecting channel portion 63. A channel connecting base portion 67 is provided under the support connecting channel 63 to be received in the channel 68 defined by the lower wall 50' of the channel 50. The flexible flanges 66 are disposed for contact with an end edge, herein the end edge 60' of the concrete tile 53, shown in FIG. 7A, to provide for lateral bracing and shock absorption if the tiles are displaced laterally. Again, as with respect to the decking support connectors 17, the decking floor member support section 63 can be provided of different thicknesses as shown between the connectors of FIGS. 9A and 9B to accommodate concrete tiles or other tiling material of different thicknesses.

The decking floor members 16, as shown in FIG. 2, are concrete tiles which have a flat top surface which may be casted with rib formations, not known but obvious to a person skilled in the art, to provide an anti-slipping surface and the bottom surface is formed with transverse concave formations 70 to receive and retain conduits 20 thereunder.

Referring again to FIG. 4, it can be seen that the top walls 22 of the side rails 11 are provided with integrally formed elongated connecting channels 71 and 71' each having a slot opening 72 and opposed recess cavities 73 under opposed side edges of the slot opening. This connecting channel provides for the removable connection of dock accessories such as cleats, etc., not shown but obvious to a person skilled in the art. The top wall 22 may also be formed with an elongated slot 74 of arcuate cross-section for snap-fit retention of an elongated illuminating ribbon 75 of substantially circular cross-section and having encapsulated therein a plurality of light emitting diodes 76 (LEDs) to provide a night boundary demarcation of the floating dock structure. Alternatively, a simple illuminating ribbon insert, formed of fluorescent material, may be inserted in the slot 74 to provide demarcation when illuminated from above, as such docks are usually equipped with light posts secured thereto.

The exterior side wall 23 of the side rails 11, 11' as hereinshown are provided with integrally formed elongated connecting channels 80, 80' and 80" for the connection to an anchoring system or other connectors for dock accessories. It is also provided with an elongated slot 81 for the retention of an elongated illuminating ribbon such as the ribbon 75 shown in the top wall to provide night indication of the side rails.

Figure 3B:
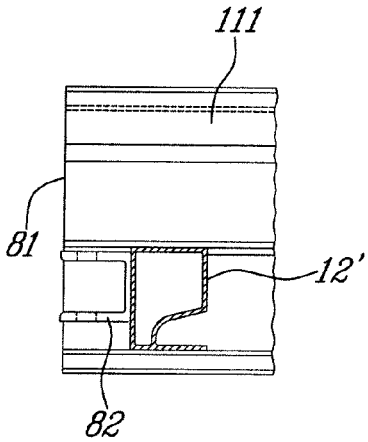
FIG. 3B is a fragmented section view of a corner of the dock showing a dock connecting flange secured to an end cross-member.

As shown in FIGS. 1 and 3B, the end cross-member 12' of the floating dock structure is secured recessed from the ends 81 of the side rails 11 and 11' whereby to accommodate a deck connecting flange 82 which is provided for interconnection of the floating dock structure to another floating dock structure or to a shore anchoring system as is also obvious to a person skilled in the art.

Figure 4:
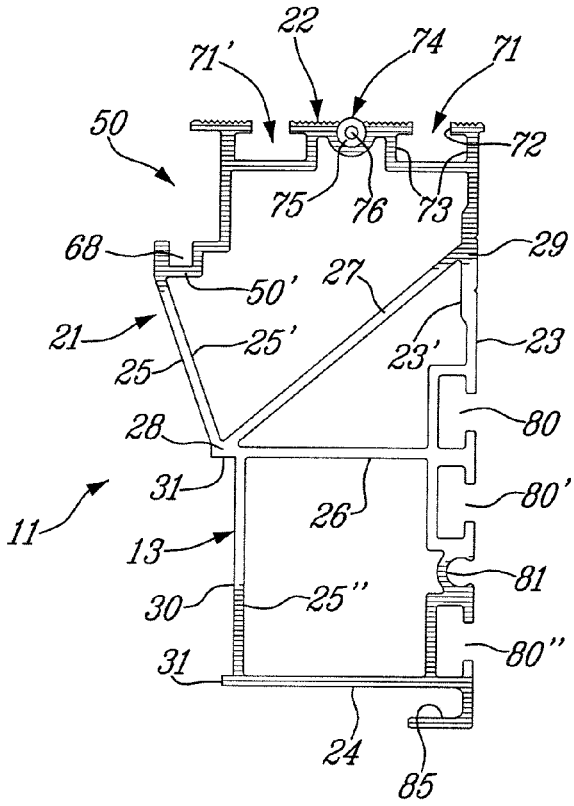
FIG. 4 is an enlarged section view illustrating the profile of the aluminum extruded side rail.

With further reference to FIGS. 2 and 4, it can also be seen that the side rails 11 and 11' are provided with a lower flange receiving channel 85 whereby to receive the connecting flange 42 of a floatation casing 86 of the type shown in FIG. 2. These connecting flanges 42 are formed integral about the floatation casing 86 and are also connected to some of the cross-members 12, as shown in FIG. 5.

It is within the ambit of the present invention to cover any obvious modifications of the preferred embodiment described herein, provided such modifications fall within the scope of the appended claims.

The invention claimed is:

1. A floating dock structure comprising a pair of side rails secured together in spaced-apart substantially parallel relationship by a plurality of cross-members connected between said side rails to a lower tubular portion of said side rails; said side rails each being a single-piece, hollow, tubular aluminum extruded side rails defining a top wall, an exterior side wall, a bottom wall and an interior side wall spaced inwardly from said exterior side wall; one or more braces are provided between said exterior side wall and said interior side wall, elongated deck support stringers secured in spaced-apart relationship on a top wall of said cross-members and extending in substantially parallel relationship to each other and to said side rails, decking floor members supported by said deck support stringers elevated from said top wall of said cross-members to create underfloor passages to receive conduits having outside diameters of up to five inches and services material, and connectors to secure floats under said cross-members.

2. A floating dock structure as claimed in claim 1 wherein said hollow extruded side rails each define a top reinforced structural portion above said lower tubular portion, said interior side wall having an integrally formed deck supporting connecting channel in a top part thereof, said one or more braces being formed by integrally formed structural bracing walls interconnecting said exterior side wall to said interior side wall to transfer lateral loads applied to said side rails into said cross-members.

3. A floating dock structure as claimed in claim 2 wherein one of said bracing walls is a diagonal bracing wall extending from about mid-length of said exterior side wall in said top reinforced structural portion to a lower end of said interior side wall in said top reinforced structural portion to terminate at a top edge of said lower tubular portion, said mid-length of said exterior side wall having a thickened wall portion.

4. A floating dock structure as claimed in claim 3 wherein said lower tubular portion is a lower rectangular tubular portion of said rail, said interior side wall of said lower rectangular tubular portion having an outwardly extending channel defined between spaced-apart connecting flanges projecting from opposed ends of said interior side wall in said lower securement portion to define therebetween a cross-member connecting channel to which said cross-members are welded.

5. A floating dock structure as claimed in claim 2 wherein one or more decking support isolating connectors are removably secured to said deck supporting connecting channel of said interior side wall of said side rails and to a top end of said elongated deck support stringers.

6. A floating dock structure as claimed in claim 5 wherein said decking support isolating connectors are interchangeable connectors to provide for a height adjustment between said top wall of said cross-members and said top wall of said side rails to accommodate said decking floor members of a different thickness.

7. A floating dock structure as claimed in claim 5 wherein said decking support isolating connectors are formed of insulating material.

8. A floating dock structure as claimed in claim 7 wherein said decking support isolating connectors which are secured to said elongated deck support stringers are provided with a central vertical flange wall projecting centrally from a top wall thereof and disposed for longitudinal alignment with said elongated deck support stringers, said decking floor members being rectangular concrete tiles dimensioned to span and be supported by adjacent parallel ones of said elongated deck support stringers with said vertical flange wall disposed between opposed side edges of opposed ones of said rectangular concrete tiles.

9. A floating dock structure as claimed in claim 7 wherein said decking support isolating connectors adapted to connect to said deck supporting connecting channel of said interior side wall of said side rails are configured to define a decking floor member support section and a flexible end wall disposed to an inner side of said floor member support section and projecting thereabove, said flexible end wall having at least one angulated flexible flange projecting towards said support section for contact with an end edge of said decking floor member.

10. A floating dock structure as claimed in claim 8 wherein said rectangular concrete tiles have a flat top surface and a bottom surface provided with one or more transverse concave formations to provide a clearance for tubular conduits.

11. A floating dock structure as claimed in claim 7 wherein said insulating material is a polyvinylchloride (PVC) plastics material.

12. A floating dock structure as claimed in claim 7 wherein said decking floor members are concrete tiles, said concrete tiles being supported along a pair of opposed parallel edge portions thereof by opposed parallel ones of said decking support isolating connectors to isolate said concrete tiles from contact with said side rails and elongated deck support stringers.

13. A floating dock structure as claimed in claim 1 wherein said cross-members are elongated, hollow, aluminum extruded members; each cross-member having a top wall, opposed spaced-apart side walls, and a bottom wall to form an anti-torquing tubular structural rigid portion; one of said side walls having an inwardly angulated lower wall portion terminating in said bottom wall whereby said bottom wall defines a connecting flange wall portion, and a flange access space formed between said connecting flange portion and said inwardly angulated lower portion of said one of said side walls of said cross-member.

14. A floating dock structure as claimed in claim 13 wherein said connecting flange portion is provided with holes to receive connecting bolts to secure floatation casings under said cross-members, said flange access space permitting the positioning of said connecting bolts in said holes and access thereto.

15. A floating dock structure as claimed in claim 2 wherein said top wall of said side rails is provided with one or more integrally formed elongated connecting channel, said connecting channel having a slot opening and opposed recessed cavity under opposed side edges of said slot opening, said connecting channel providing for the connection of dock accessories thereto.

16. A floating dock structure as claimed in claim 15 wherein said top wall of said side rails is further provided with an elongated slot of arcuate cross-section for snap-fit retention of an elongated illuminating ribbon of substantially circular cross-section therein to provide a night boundary demarcation of said floating dock structure.

17. A floating dock structure as claimed in claim 16 wherein said illuminating ribbon is one of a plastics ribbon having light emitting diodes (LEDs) serially connected therealong or a ribbon of fluorescent material.

18. A floating dock structure as claimed in claim 15 wherein said exterior side wall of said side rails is provided with at least one of said integrally formed elongated connecting channels for the connection of connectors of an anchoring system and other of said dock accessories, and an elongated slot for retention of an elongated illuminating ribbon to provide a night indication of said side rails.

19. A floating dock structure as claimed in claim 3 wherein said thickened wall portion is adapted to receive lag bolts therethrough to secure a bumper against the exterior side wall of said top reinforced structural portion of said side rails.

* * * * *